United States Patent [19]

Wood et al.

[11] 4,425,711

[45] Jan. 17, 1984

[54] DOUBLE-ENDED DOUBLY-CONCAVED BABY SPOON

[76] Inventors: Geraldine E. Wood, 1220 Orchard, Springfield, Ill. 62702; Ralph F. Staubly, 84 Danbury Dr., Springfield, Ill. 62704

[21] Appl. No.: 208,232

[22] Filed: Nov. 12, 1980

Related U.S. Application Data

[63] Continuation-in-part of Ser. No. 53,190, Jun. 29, 1979, abandoned.

[51] Int. Cl.[3] ..... A47J 43/28

[52] U.S. Cl. ..... 30/324

[58] Field of Search ..... 30/324

[56] References Cited

U.S. PATENT DOCUMENTS

| | | | |
|---|---|---|---|
| D. 92,118 | 4/1934 | Stuart | 30/324 |
| D. 127,611 | 6/1941 | Hadfield | 30/324 |
| D. 156,850 | 1/1950 | Shirley | 30/324 |
| D. 204,788 | 5/1966 | De Mieri | 30/324 |
| D. 228,722 | 10/1973 | Grimes | 30/324 |
| 265,390 | 10/1882 | Cosbey | 30/324 |
| 2,401,534 | 6/1946 | Welch | 30/324 |
| 2,654,252 | 10/1953 | Davis | 30/324 |
| 2,683,374 | 7/1954 | Finley | 30/324 |
| 2,824,369 | 2/1958 | Welch | 30/324 |
| 3,795,062 | 3/1974 | Lamb | 30/324 |

FOREIGN PATENT DOCUMENTS

| | | | |
|---|---|---|---|
| 22952 | 11/1898 | United Kingdom | 30/324 |

*Primary Examiner*—Frederick R. Schmidt
*Assistant Examiner*—J. T. Zatarga
*Attorney, Agent, or Firm*—Ralph F. Staubly

[57] ABSTRACT

A metal or plastic spoon for babies has, at each end of a generally flat handle, a generally flat head having oppositely facing food-holding concavities. The handle margins and the rims of the heads are safely rounded to avoid sharp edges that could injure the baby. The double-concave and double-ended construction facilitates self-feeding and accelerates its learning by making the spoon always functional when held in a closed hand.

1 Claim, 3 Drawing Figures

DOUBLE-ENDED DOUBLY-CONCAVED BABY SPOON

This is a continuation-in-part of abandoned application Ser. No. 53,190, filed June 29, 1979 and identically entitled.

BACKGROUND AND OBJECTS OF THE INVENTION

A double-ended spoon for babies is known (U.S. Pat. No. 3,795,062 to Lamb). But none is known to have same-sized double ends with oppositely facing same-sized concavities at each end. It is the principal object of this invention to provide such a spoon. Other objects and advantages of the invention will become apparent as the following detailed description proceeds.

BRIEF DESCRIPTION OF THE DRAWING FIGURES

DETAILED DESCRIPTION

Figure 1:
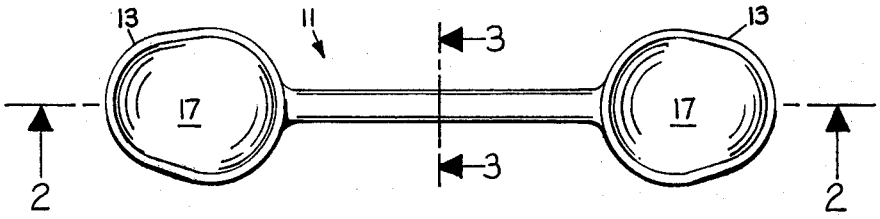
FIG. 1 is a plan view of a preferred embodiment of the invention.
Figure 2:
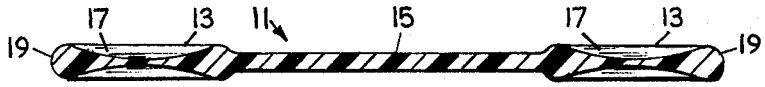
FIG. 2 is an elevational view in section taken on the line 2—2 of FIG. 1.
Figure 3:
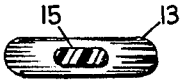
FIG. 3 is an enlarged elevational view in section taken on the line 3—3 of FIG. 1.

With reference now to the drawings, the numeral 11 generally designates a baby spoon which can be made of metal or plastic material. The spoon 11 comprises two same-sized generally flat co-planar heads 13 connected by a generally flat handle part 15. The heads 13 have oppositely facing same-sized concavities 17, which can be made deeper than shown by increasing the size of the rims 19.

The rims 19 and the margins of the handle part 15 are rounded for safety and for comfortable holding.

The invention having been described, what is claimed is:

1. A spoon having smooth rounded edge and end surfaces for facilitating self-feeding and for safely accelerating its learning by a baby, comprising: an elongated generally flat handle member including round smooth margins along its edges and a pair of generally flat heads integrally connected to said handle member, said heads having the same size and egg-shape in plan view, one head of said pair of heads fixed to each end of said handle member, said handle member and each of said heads lying in substantially parallel planes and each of said heads have oppositely disposed, same-sized concavities formed therein and equally spaced on each side of a plane through the handle with a smooth rounded rim formed around said oppositely disposed concavities and said handle, the thickness of each hand being equal and of slightly greater dimension than the thickness of the handle member, the length of the handle member being approximately twice the length of a head, and each of said four concavities being of the same size and shape.

* * * * *